US006991048B2

(12) United States Patent
Zupanick

(10) Patent No.: US 6,991,048 B2
(45) Date of Patent: Jan. 31, 2006

(54) WELLBORE PLUG SYSTEM AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 56 days.

(21) Appl. No.: 10/194,422

(22) Filed: Jul. 12, 2002

(65) Prior Publication Data

US 2004/0007390 A1 Jan. 15, 2004

(51) Int. Cl.
*E21B 7/04* (2006.01)

(52) U.S. Cl. ..... 175/61; 175/80; 166/50; 166/117.6; 166/313

(58) Field of Classification Search ..... 166/313, 166/50, 117.6; 125/61, 62, 8 F
See application file for complete search history.

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,208,537 | A | 9/1965 | Scarborough | 175/53 |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,151,880 | A | 5/1979 | Vann | |

4,156,437 A 5/1979 Chivens et al. ..... 137/554
4,169,510 A 10/1979 Meigs ..... 175/65
4,182,423 A 1/1980 Ziebarth et al.
4,189,184 A 2/1980 Green ..... 299/8
4,220,203 A 9/1980 Steeman ..... 166/271
4,221,433 A 9/1980 Jacoby ..... 299/4
4,222,611 A 9/1980 Larson et al.
4,224,989 A 9/1980 Blount ..... 166/250
4,226,475 A 10/1980 Frosch et al.
4,257,650 A 3/1981 Allen ..... 299/2
4,278,137 A 7/1981 Van Eek, deceased ..... 175/267
4,283,088 A 8/1981 Tabakov et al. ..... 299/2
4,296,785 A 10/1981 Vitello et al. ..... 141/105
4,299,295 A 11/1981 Gossard ..... 175/45
4,303,127 A 12/1981 Freel et al.
4,305,464 A 12/1981 Masszi ..... 166/370
4,312,377 A 1/1982 Knecht ..... 137/625.19
4,317,492 A 3/1982 Summers et al. ..... 175/79
4,328,577 A 5/1982 Abbott et al. ..... 370/84
4,333,539 A 6/1982 Lyons et al.
4,366,988 A 1/1983 Bodine ..... 299/14
4,372,398 A 2/1983 Kuckes ..... 175/45
4,386,665 A 6/1983 Dellinger ..... 175/61
4,390,067 A 6/1983 Willman ..... 166/245
4,396,076 A 8/1983 Inoue ..... 175/265
4,397,360 A 8/1983 Schmidt ..... 175/61
4,401,171 A 8/1983 Fuchs ..... 175/267
4,407,376 A 10/1983 Inoue ..... 175/267
4,415,205 A 11/1983 Rehm et al.
4,417,829 A 11/1983 Berezoutzky
4,422,505 A 12/1983 Collins
4,437,706 A 3/1984 Johnson
4,442,896 A 4/1984 Reale et al. ..... 166/278
4,463,988 A 8/1984 Bouck et al.
4,494,616 A 1/1985 McKee ..... 175/67
4,502,733 A 3/1985 Grubb
4,512,422 A 4/1985 Knisley ..... 175/99
4,519,463 A 5/1985 Schuh ..... 175/61
4,527,639 A 7/1985 Dickinson, III et al. ..... 175/61
4,532,986 A 8/1985 Mims et al. ..... 166/50
4,533,182 A 8/1985 Richards
4,536,035 A 8/1985 Huffman et al.
4,544,037 A 10/1985 Terry ..... 166/369
4,558,744 A 12/1985 Gibb ..... 166/335
4,565,252 A 1/1986 Campbell et al. ..... 175/269
4,573,541 A 3/1986 Josse et al. ..... 175/78
4,599,172 A 7/1986 Gardes ..... 210/314
4,600,061 A 7/1986 Richards ..... 175/62
4,603,592 A 8/1986 Siebold et al.
4,605,076 A 8/1986 Goodhart ..... 175/61
4,611,855 A 9/1986 Richards ..... 299/2
4,618,009 A 10/1986 Carter et al. ..... 175/267
4,638,949 A 1/1987 Mancel ..... 239/307
4,646,836 A 3/1987 Goodhart ..... 166/303
4,651,836 A 3/1987 Richards
4,674,579 A 6/1987 Geller et al. ..... 175/45
4,702,314 A 10/1987 Huang et al. ..... 166/245
4,705,431 A 11/1987 Gadelle et al. ..... 405/267
4,715,440 A 12/1987 Boxell et al. ..... 166/100
4,753,485 A 6/1988 Goodhart
4,754,819 A 7/1988 Dellinger ..... 175/61
4,756,367 A 7/1988 Puri et al. ..... 166/263
4,763,734 A 8/1988 Dickinson et al. ..... 175/61
4,773,488 A 9/1988 Bell et al. ..... 175/61
4,776,638 A 10/1988 Hahn
4,830,105 A 5/1989 Petermann ..... 166/241
4,832,122 A 5/1989 Corey et al.
4,836,611 A 6/1989 El-Saie ..... 299/7
4,842,081 A 6/1989 Parant ..... 175/23
4,844,182 A 7/1989 Tolle ..... 175/215
4,852,666 A 8/1989 Brunet et al. ..... 175/61
4,883,122 A 11/1989 Puri et al. ..... 166/248
4,889,186 A 12/1989 Hanson et al.
4,978,172 A 12/1990 Schwoebel et al. ..... 299/12
5,016,710 A 5/1991 Renard et al. ..... 166/245
5,035,605 A 7/1991 Dinerman et al. ..... 481/18
5,036,921 A 8/1991 Pittard et al. ..... 166/298
5,074,360 A 12/1991 Guinn ..... 166/281
5,074,365 A 12/1991 Kuckes ..... 175/40
5,074,366 A 12/1991 Karlsson et al. ..... 175/76
5,082,054 A 1/1992 Kiamanesh ..... 166/248
5,111,893 A 5/1992 Kvello-Aune ..... 175/258
5,121,244 A 6/1992 Takasaki
5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,194,977 A 3/1993 Nishio
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr.
5,240,350 A 8/1993 Yamaguchi et al. ..... 405/143
5,242,017 A 9/1993 Hailey ..... 166/55.8
5,242,025 A 9/1993 Neill et al.
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,301,760 A 4/1994 Graham ..... 175/61
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al.
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A * 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo
5,615,739 A 4/1997 Dallas ..... 166/306
5,653,286 A 8/1997 McCoy et al.
5,659,347 A 8/1997 Taylor
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4

| | | | | |
|---|---|---|---|---|
| 5,697,445 | A | 12/1997 | Graham | |
| 5,706,871 | A | 1/1998 | Anderson et al. | 141/59 |
| 5,720,356 | A | 2/1998 | Gardes | 175/62 |
| 5,727,629 | A | 3/1998 | Blizzard, Jr. et al. | 166/298 |
| 5,735,350 | A | 4/1998 | Longbottom et al. | 166/313 |
| 5,771,976 | A | 6/1998 | Talley | 166/370 |
| 5,775,433 | A | 7/1998 | Hammett et al. | |
| 5,775,443 | A | 7/1998 | Lott | |
| 5,785,133 | A | 7/1998 | Murray et al. | 175/61 |
| 5,832,958 | A | 11/1998 | Cheng | 137/625.41 |
| 5,852,505 | A | 12/1998 | Li | |
| 5,853,054 | A | 12/1998 | McGarian et al. | 175/267 |
| 5,853,056 | A | 12/1998 | Landers | 175/424 |
| 5,853,224 | A | 12/1998 | Riese | |
| 5,863,283 | A | 1/1999 | Gardes | 588/250 |
| 5,867,289 | A | 2/1999 | Gerstel et al. | |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,912,754 | A | 6/1999 | Koga et al. | |
| 5,914,798 | A | 6/1999 | Liu | |
| 5,917,325 | A | 6/1999 | Smith | 324/326 |
| 5,934,390 | A | 8/1999 | Uthe | 175/67 |
| 5,938,004 | A | 8/1999 | Roberts et al. | |
| 5,941,308 | A | 8/1999 | Malone et al. | |
| 5,957,539 | A | 9/1999 | Durup et al. | 299/4 |
| 5,971,074 | A | 10/1999 | Longbottom et al. | 166/313 |
| 5,992,524 | A * | 11/1999 | Graham | 166/313 |
| 6,012,520 | A | 1/2000 | Yu et al. | 166/245 |
| 6,015,012 | A | 1/2000 | Reddick | |
| 6,019,173 | A | 2/2000 | Saurer et al. | |
| 6,024,171 | A | 2/2000 | Montgomery et al. | 166/308 |
| 6,030,048 | A | 2/2000 | Hsu | |
| 6,050,335 | A | 4/2000 | Parsons | 166/272.3 |
| 6,056,059 | A | 5/2000 | Ohmer | 166/313 |
| 6,062,306 | A | 5/2000 | Gano et al. | |
| 6,065,550 | A | 5/2000 | Gardes | 175/62 |
| 6,065,551 | A | 5/2000 | Gourley et al. | |
| 6,119,771 | A | 9/2000 | Gano et al. | 166/50 |
| 6,119,776 | A | 9/2000 | Graham et al. | |
| 6,135,208 | A | 10/2000 | Gano et al. | 166/313 |
| 6,179,054 | B1 | 1/2001 | Stewart | |
| 6,179,659 | B1 | 1/2001 | Moden | |
| 6,189,616 | B1 | 2/2001 | Gano et al. | |
| 6,209,636 | B1 * | 4/2001 | Roberts et al. | 166/117.6 |
| 6,237,284 | B1 | 5/2001 | Erickson | |
| 6,244,340 | B1 | 6/2001 | McGlothen et al. | |
| 6,279,658 | B1 | 8/2001 | Donovan et al. | |
| 6,280,000 | B1 | 8/2001 | Zupanick | 299/12 |
| 6,349,769 | B1 | 2/2002 | Ohmer | 166/313 |
| 6,357,523 | B1 | 3/2002 | Zupanick | 166/52 |
| 6,357,530 | B1 | 3/2002 | Kennedy et al. | |
| 6,425,448 | B1 | 7/2002 | Zupanick et al. | 175/61 |
| 6,450,256 | B2 | 9/2002 | Mones | |
| 6,454,000 | B1 | 9/2002 | Zupanick | |
| 6,457,540 | B2 | 10/2002 | Gardes | |
| 6,497,556 | B2 | 12/2002 | Zupanick | |
| 6,561,288 | B2 | 5/2003 | Zupanick | |
| 6,566,649 | B1 | 5/2003 | Mickael | |
| 6,571,888 | B2 | 6/2003 | Comeau et al. | |
| 6,577,129 | B1 | 6/2003 | Thompson et al. | |
| 6,585,061 | B2 | 7/2003 | Radzinski et al. | |
| 6,590,202 | B2 | 7/2003 | Mickael | |
| 6,591,903 | B2 | 7/2003 | Ingle et al. | |
| 6,604,910 | B1 | 8/2003 | Zupanick | |
| 6,607,042 | B2 | 8/2003 | Hoyer et al. | |
| 6,636,159 | B1 | 10/2003 | Winnacker | |
| 6,639,210 | B2 | 10/2003 | Odom et al. | |
| 6,646,441 | B2 | 11/2003 | Thompson et al. | |
| 6,653,839 | B2 | 11/2003 | Yuratich et al. | |
| 6,679,322 | B1 | 1/2004 | Zupanick | |
| 6,708,764 | B2 | 3/2004 | Zupanick | |
| 6,725,922 | B2 | 4/2004 | Zupanick | |
| 6,758,279 | B2 | 7/2004 | Moore et al. | |
| 2002/0043404 | A1 | 4/2002 | Trueman et al. | |
| 2002/0050358 | A1 | 5/2002 | Algeroy et al. | |
| 2002/0074120 | A1 | 6/2002 | Scott | 166/313 |
| 2003/0066686 | A1 | 4/2003 | Conn | |
| 2003/0075334 | A1 * | 4/2003 | Haugen etal. | 166/313 |
| 2003/0164253 | A1 | 9/2003 | Trueman et al. | |
| 2003/0221836 | A1 | 12/2003 | Gardes | |
| 2004/0011560 | A1 | 1/2004 | Rial et al. | |
| 2004/0033557 | A1 | 2/2004 | Scott et al. | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |

FOREIGN PATENT DOCUMENTS

| | | | | |
|---|---|---|---|---|
| AU | 85/49964 | A | 11/1986 | |
| CA | 2210866 | | 1/1998 | |
| CA | 2278735 | | 8/1998 | |
| CH | 653741 | A5 | 1/1986 | |
| DE | 197 25 996 | A1 | 1/1998 | |
| EP | 0 819 834 | A1 | 1/1998 | |
| EP | 0 875 661 | A1 | 11/1998 | |
| EP | 0 952 300 | A1 | 10/1999 | |
| EP | 1 316 673 | A2 | 6/2003 | |
| FR | 964503 | | 4/1944 | 8/1 |
| GB | 442008 | | 1/1936 | |
| GB | 444484 | | 3/1936 | |
| GB | 651468 | | 4/1951 | |
| GB | 893869 | | 4/1962 | |
| GB | 2 255 033 | A | 10/1992 | |
| GB | 2 297 988 | | 8/1996 | |
| GB | 2 347 157 | A | 8/2000 | |
| SU | 750108 | A1 | 6/1975 | |
| SU | 876968 | | 10/1981 | |
| SU | 1448078 | A1 | 3/1987 | |
| SU | 1770570 | A1 | 3/1990 | |
| WO | 94/21889 | | 9/1994 | |
| WO | WO 94/28280 | | 12/1994 | |
| WO | WO 97/21900 | | 6/1997 | |
| WO | WO 98/35133 | | 8/1998 | |
| WO | WO 99/60248 | | 11/1999 | |
| WO | 00/31376 | | 6/2000 | |
| WO | WO 00/79099 | | 12/2000 | |
| WO | WO 01/44620 | A1 | 6/2001 | |
| WO | WO 02/18738 | | 3/2002 | |
| WO | WO 02/059455 | | 8/2002 | |
| WO | WO 02/061238 | | 8/2002 | |
| WO | WO 03/102348 | | 12/2003 | |
| WO | WO 2004/035984 | A1 | 4/2004 | |

OTHER PUBLICATIONS

Fipke, S., et al., "*Economical Multilateral Well Technology for Canadian Heavy Oil,*" Petroleum Society, Canadian Institute of Mining, Metallurgy & Petroleum, Paper 2002–100, to be presented in Calgary Alberta, Jun. 11–13, 2002, pp. 1–11.

PowerPoint Presentation entitled, "Horizontal Coalbed Methane Wells," by Bob Stayton, Computalog Drilling Serivices, date is believed to have been in 2002 (39 pages).

Denney, Dennis, "*Drilling Maximum–Reservoir–Contact Wells in the Shaybah Field,*" SPE 85307, pp. 60, 62–63, Oct. 20, 2003.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Desai, Praful, et al., "*Innovative Design Allows Construction of Level 3 or Level 4 Junction Using the Same Platform,*" SPE/Petroleum Society of CIM/CHOA 78965, Canadian Heavy Oil Association, 2002, pp. 1–11.

Bybee, Karen, "*Advanced Openhole Multilaterals*" Horizontal Wells, Nov. 2002, pp. 41–42.

Bybee, Karen, "*A New Generation Multilateral System for the Troll Olje Field,*" Multilateral/Extended Reach, Jul. 2002, pp. 50–51.

Emerson,, A.B., et al., "*Moving Toward Simpler, Highly Functional Multilateral Completions,*" Technical Note, Journal of Canadian Petroleum Technology, May 2002, vol. 41, No. 5, pp. 9–12.

Moritis, Guntis, "*Complex Well Geometries Boost Orinoco Heavy Oil Producing Rates,*" XP–000969491, Oil & Gas Journal, Feb. 29, 2000, pp. 42–46.

Thernig, Dan, "*Multilateral Thinking,*" New Technology Magazine, Dec. 1999, pp. 24–25.

Smith, R.C., et al., "*The Lateral Tie–Back System: The Ability to Drill and Case Multiple Laterals,*" IADC/SPE 27436, Society of Petroleum Engineers, 1994, pp. 55–64, plus Multilateral Services Profile (1 page) and Multilateral Services Specifications (1 page).

Notification of Transmittal of the International Search Report or the Declaration (PCT Rule 44.1) (3 pages) and International Search Report (4 pages) re International Application No. PCT/US 03/13954 mailed Sep. 1, 2003.

Logan, Terry L., "*Drilling Techniques for Coalbed Methane,*" Hydrocarbons From Coal, Chapter 12, Cover Page, Copyright Page, pp. 269–285, Copyright 1993.

Hanes, John, "*Outbursts in Leichardt Colliery: Lessons Learned,*" International Symposium–Cum–Workshop on Management and Control of High Gas Emissions and Outbursts in Underground Coal Mines, Wollongong, NSW, Australia, Mar. 20–24, 1995, Cover page, pp. 445–449.

Williams, Ray, et al., "*Gas Reservoir for Mine Gas Emission Assessment,*" Bowen Basin Symposium 2000, pp. 325–333.

Brown, K., et al., "*New South Wales Coal Seam Methane Potential,*" Petroleum Bulletin 2, Department of Mineral Resources, Discovery 2000, Mar. 1996, pp. i–viii, 1–96.

Zupanick, U.S. patent application entitled "Method and System for Accessing a Subterranean Zone From a Limited Surface Area," U.S. Appl. No. 10/406,037, filed Apr. 2, 2003.

Chi, Weiguo, "*A Feasible Discussion On Exploitation Coalbed Methane Through Horizontal Network Drilling In China,*" SPE 64709, Society of Petroleum Engineers (SPE International), Nov. 7, 2000, 4 pages.

B. Goktas et al., "*Performance of Openhole Completed and Cased Horizontal/Undulating Wells in Thin–Bedded, Tight Sand Gas Reservoirs,*" SPE 65619 Society of Petroleum Engineers, Oct. 17–19, 2000, (7 pages).

R. Sharma et al., "*Modelling of Undulating Wellbore Trajectories,*" The Journal of Canadian Petroleum Technology, vol. 34, No. 10, XP–002261908, Oct. 18–20, 1993 pp. 16–24.

E.F. Balbinski, "*Prediction of Offshore Viscous Oil Field Performance,*" European Symposium on Improved Oil Recovery, Aug. 18–20, 1999, pp. 1–6, 9 & 10.

Notification of Transmittal of the International Search Report or the Declaration (PCT Rule 44.1) (3 pages) and International Search Report (4 pages) re International Application No. PCT/US 03/21626 mailed Nov. 6, 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Notification of Transmittal of the International Search Report or the Declaration (PCT Rule 44.1) (3 pages) and International Search Report (5 pages) re International Application No. PCT/US 03/21750 mailed Dec. 5, 2003.

Fletcher, Sam, "*Anadarko Cuts Route Under Canadian River Gorge,*" Oil & Gas Journal, pp. 28–30, Jan. 5, 2004.

Kalinin, et al., Translation of Selected Pages, "*Drilling Inclined and Horizontal Well Bores,*" Moscow, Nedra Publishers, 15 pages, 1997.

Arens, V. Zh., Translation of Selected Pages, "Well–Drilling Recovery of Minerals," Moscow, Nedra Publishers, 7 pages, 1986.

Jet Lavanway Exploration, "*Well Survey,*" Key Energy Surveys, 3 pages, Nov. 2, 1997.

U.S. Dept. of Energy, "*New Breed of CBM/CMM Recovery Technology,*" 1 page, Jul. 2003.

Precision Drilling, "*We Have Roots in Coal Bed Methane Drilling,*" Technology Services Group, 1 page, Published on or before Aug. 5, 2002.

Dick Ghiselin, "*Unconventional Vision Frees Gas Reserves,*" Natural Gas Quarterly, 2 pages, Sep. 2003.

CBM Review, World Coal, "*US Drilling into Asia,*" 4 pages, Jun. 2003.

Chris Skrebowski, "*US Interest in North Korean Reserves,*" Petroleum, Energy Institute, 4 pages, Jul. 2003.

Zupanick, U.S. patent application entitled "System and Method for Subterranean Access," U.S. Appl. No. 10/227,057, filed Aug. 22, 2002 (Publication 2004/0035582).

Zupanick et al., U.S. patent application entitled "Method and System for Controlling Pressure in a Dual Well System," U.S. Appl. No. 10/244,082, filed Sep. 12, 2002.

Zupanick, U.S. patent application entitled "Three–Dimensional Well System for Accessing Subterranean Zones." U.S. Appl. No. 10/244,083, filed Sep. 12, 2002 (Publication 2004/0050552).

Zupanick et al., U.S. patent application entitled "Accelerated Production of Gas From a Subterranean Zone," U.S. Appl. No. 10/246,052, filed Sep. 17, 2002 (Publication 2004/0050554).

Diamond et al., U.S. patent application entitled "Method and System for Removing Fluid From a Subterranean Zone Using an Enlarged Cavity", U.S. Appl. No. 10/264,535, filed Oct. 3, 2002.

Zupanick, U.S. patent application entitled "Method of Drilling Lateral Wellbores From a Slant Wall Without Utilizing a Whipstock," U.S. Appl. No. 10/267,426, filed Oct. 8, 2002.

Zupanick, U.S. patent application entitled "Method and System for Circulating Fluid in a Well System," U.S. Appl. No. 10/323,192, filed Dec. 18, 2002 (Publication 2004/0055787).

Rial et al., U.S. patent application entitled "Method and System for Controlling the Production Rate Of Fluid From A Subterranean Zone To Maintain Production Bore Stability In The Zones," U.S. Appl. No. 10/328,408, filed Dec. 23, 2002.

Zupanick et al., U.S. patent application entitled "Method and System for Recirculating Fluid in a Well System," U.S. Appl. No. 10/457,103, filed Jun. 5, 2003.

Zupanick, U.S. patent application entitled "Method and System for Accessing Subterranean Deposits from the Surface and Tools Therefor," U.S. Appl. No. 10/630,345, filed Jul. 29, 2003.

Zupanick, U.S. patent application entitled "Method and System for Accessing Subterranean Deposits from the Surface," U.S. Appl. No. 10/641,856, filed Aug. 15, 2003 (Publication 2004/0031609).

Pauley, Steven, U.S. patent application entitled "Multi–Purpose Well Bores and Method for Accessing a Subterranean Zone From the Surface," U.S. Appl. No. 10/715,300, filed Nov. 17, 2003.

Seams, Douglas, U.S. patent application entitled "Method and System for Extraction of Resources from a Subterranean Well Bore," filed Nov. 26, 2003, U.S. Appl. No. 10/723,322.

Zupanick, U.S. patent application entitled "Slant Entry Well System and Method," filed Dec. 31, 2003, U.S. Appl. No. 10/749,884.

Zupanick, U.S. patent application entitled "Method and System for Accessing a Subterranean Deposits from the Surface," U.S. Appl. No. 10/761,629, filed Jan. 20, 2004.

Zupanick, U.S. patent application entitled "Method and System for Testing A Partially Formed Hydrocarbon Well for Evaluating and Well Planning Refinement," U.S. Appl. No. 10/769,221, filed Jan. 30, 2004.

Platt, "Method and System for Lining Multilateral Wells," U.S. Appl. No. 10/772,841, filed Feb. 5, 2004.

Zupanick, "Three–Dimensional Well System For Accessing Subterranean Zones," filed Feb. 11, 2004, U.S. Appl. No. 10/777,503.

Zupanick, "System And Method For Directional Drilling Utilizing Clutch Assembly," U.S. Appl. No. 10/811,118, filed Mar. 25, 2004.

Zupanick et al., "Slot Cavity," U.S. Appl. No. 10/419,529, filed Apr. 21, 2003.

Zupanick, "System and Method for Multiple Wells from a Common Surface Location," U.S. Appl. No. 10/788,694, filed Feb. 27, 2004.

Palmer, Ian D., et al., "*Coalbed Methane Well Completions and Stimulations,*" Chapter 14, Hydrocarbons From Coal, American Association of Petroleum Geologists, 1993, pp. 303–339.

Notification of Transmittal of the International Search Report or the Declaration (PCT Rule 44.1) mailed Dec. 19, 2003 (6 pages) re International Application No. PCT/US 03/28137.

Notification of Transmittal of the International Search Report or the Declaration (PCT Rule 44.1) mailed Feb. 4, 2004 (8 pages) re International Application No. PCT/US 03/26124.

Smith, Maurice, "*Chasing Unconventional Gas Unconventionally,*" CBM Gas Technology, New Technology Magazine, Oct./Nov. 2003, pp. 1–4.

Gardes, Robert "*A New Direction in Coalbed Methane and Shale Gas Recovery,*" (to the best of Applicants' recollection, first received at The Canadian Institute Coalbed Methane Symposium conference on Jun. 16 and Jun. 17, 2002), 1 page of conference flyer, 6 pages of document.

Gardes, Robert, "*Under–Balance Multi–Lateral Drilling for Unconventional Gas Recovery,*" (to the best of Applicants' recollection, first received at The Unconventional Gas Revolution conference on Dec. 9, 2003), 4 pages of conference flyer, 33 pages of document.

Boyce, Richard "*High Resolution Selsmic Imaging Programs for Coalbed Methane Development,*" (to the best of Applicants' recollection, first received at The Unconventional Gas Revolution conference on Dec. 10, 2003), 4 pages of conference flyer, 24 pages of document.

Mark Mazzella and David Strickland, "*Well Control Operations on a Multiwell Platform Blowout,*" WorldOil.com—Online Magazine Article, vol. 22, Part I—pp. 1–7, and Part II—pp. 1–13, Jan. 2002.

Vector Magnetics LLC, Case History, California, May 1999, "*Successful Kill of a Surface Blowout,*" pp. 1–12, May 1999.

Cudd Pressure Control, Inc, "*Successful Well Control Operations–A Case Study: Surface and Subsurface Well Intervention on a Multi–Well Offshore Platform Blowout and Fire,*" pp. 1–17, http:/www.cuddwellcontrol.com/literature/successful/successful_well.htm, 2000.

R. Purl, et al., "*Damage to Coal Permeability During Hydraulic Fracturing,*" pp. 109–115 (SPE 21813), 1991.

U.S. Dept. of Energy—Office of Fossil Energy, "*Multi–Seam Well Completion Technology: Implications for Powder River Basin Coalbed Methane Production,*" pp. 1–100, A–1 through A10, Sep. 2003.

U.S. Dept. of Energy—Office of Fossil Energy, "*Powder River Basin Coalbed Methane Development and Produced Water Management Study,*" pp. 1–111, A–1 through A14, Sep. 2003.

Notification of Transmittal of the International Search Report or the Declaration (PCT Rule 44.1) mailed Nov. 5, 2003 (8 pages) re International Application No. PCT/US 03/21627, Nov. 7, 2003.

Notification of Transmittal of the International Search Report or the Declaration (PCT Rule 44.1) mailed Nov. 4, 2003 (7 pages) re International Application No. PCT/US 03/21628, Nov. 7, 2003.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven S. Bell, "Multilateral System with Full Re–Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos. 6–8, pp. 801–806, 1996.

Pascal Breant, "Des Puits Branches, Chez Total : les puits multi drains", Total Exploration Production, pp. 1–5, Jan. 1999.

Susan Eaton, "Reversal of Fortune", New Technology Magazine, pp. 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), Received Sep. 12, 2002.

Joseph A. Zupanick et al., U.S. Appl. No. 10/123,561, entitled "Method and System for Accessing Subterranean Zones From a Limited Surface," filed Apr. 5, 2002, 49 pages.

Joseph A. Zupanick et al., U.S. Appl. No. 10/123,556, entitled "Method and System for Accessing Subterranean Zones From a Limited Surface," filed Apr. 5, 2002, 49 pages.

Joseph A. Zupanick, U.S. Appl. No. 10/188,141, entitled, "Method and System for Accessing a Subterranean Zone From a Limited Surface", filed Jul. 1, 2002, 46 pages.
Joseph A. Zupanick, U.S. Appl. No. 10/194,366, entitled, "Undulating Well Bore", filed Jul. 12, 2002, 36 pages.
R.J. "Bob" Stayton, "Horizontal Wells Boost CBM Recovery", Special Report: Horizontal & Directional Drilling, *The American Oil & Gas Reporter,* pp. 71–75, Aug. 2002.
McCray and Cole, "Oil Well Drilling and Technology," *University of Oklahoma Press,* pp. 315–319, 1959.
Berger and Anderson, "Modern Petroleum;" *PennWell Books,* pp. 106–108, 1978.
Howard L. Hartman, et al.; "SME Mining Engineering Handbook;" *Society for Mining, Metallurgy, and Exploration, Inc.;* pp. 1946–1950, 2nd Edition, vol. 2, 1992.
Dave Hassan, Mike Chernichen, Earl Jensen, and Morley Frank; "Multi–lateral technique lowers drilling costs, provides environmental benefits", *Drilling Technology,* pp. 41–47, Oct. 1999.
Joseph A. Zupanick; Declaration of Experimental Use with attached Exhibits A–D, dated Nov. 12, 2000, 308 total pages.
Gopal Ramaswamy, "Production History Provides CBM Insights," *Oil & Gas Journal,* pp. 49, 50 and 52, Apr. 2, 2001.
Weiguo Chi and Luwu Yang, "Fieasibility of Coalbed Methane Exploitation in China," *Horizontal Well Technology,* p. 74, Sep. 2001.
Nackerud Product Description, *Harvest Tool Company,LLC,* 1 page, Received Sep. 27, 2001.
U.S. Appl. No. 09/444,029, entitled "Method and System for Accessing Subterranean Deposits From The Surface," filed Nov. 19, 1999, 52 pages.
U.S. Appl. No. 09/773,217, entitled "Method and System for Accessing Subterranean Zones From a Limited Surface Area", filed Jan. 30, 2001, 72 pages.
U.S. Appl. No. 09/769,098, entitled "Method and System for Enhanced Access to a Subterranean Zone," filed Jan. 24, 2001, 65 pages.
U.S. Appl. No. 10/142,817, entitled "Method and System for Underground Treatment of Materials," filed May 8, 2002, 54 pgs., May 2, 2002.
U.S. Appl. No. 09/774,996, entitled "Method and System for Accessing a Subterranean Zone From a Limited Surface Area," filed Jan. 30, 2001, 67 pages.
U.S. Appl. No. 09/932,482, entitled "Single–Blade Underreamer," filed Aug. 17, 2001, 38 pages.
U.S. Appl. No. 09/929,551, entitled "Pantograph Underreamer," filed Aug. 13, 2001, 27 pages.
U.S. Appl. No. 10/046,001, entitled "Method and System for Management of By–Products From Subterranean Zones," filed Oct. 19, 2001. 42 pages.
U.S. Appl. No. 09/932,487, entitled "Multi–Blade Underreamer," filed Aug. 17, 2001, 38 pages.
U.S. Appl. No. 09/789,956, entitled "Method and System for Accessing Subterranean Deposits From The Surface," filed Feb. 20, 2001, 54 pages.
U.S. Appl. No. 09/788,897, entitled "Method and System for Accessing Subterranean Deposits From The Surface," filed Feb. 20, 2001, 54 pages.
U.S. Appl. No. 09/791,033, entitled "Method and System for Accessing Subterranean Deposits From The Surface," filed Feb. 20, 2001, 50 pages.
U.S. Appl. No. 09/885,219, entitled "Method and System for Accessing Subterranean Deposits From The Surface," filed Jun. 20, 2001, 52 pages.
U.S. Appl. No. 09/929,175, entitled "Pantograph Underreamer," filed Aug. 13, 2001, 24 pages.
U.S. Appl. No. 09/929,568, entitled "Pantograph Underreamer," filed Aug. 13, 2001, 25 pages.
U.S. Appl. No. 10/003,917, entitled "Method and System for Surface Production of Gas from a Subterranean Zone," filed Nov. 1, 2001, 75 pages.
U.S. Appl. No. 10/004,316, entitled "Slant Entry Well System and Method," filed Oct. 30, 2001, 35 pages.
U.S. Appl. No. 10/165,627, entitled "Method and System for Accessing Subterranean Deposits from the Surface," filed Jun. 7, 2002, 26 pages.
U.S. Appl. No. 10/079,444, entitled "Pantograph Underreamer," filed Feb. 19, 2002, 32 pages.
Gopal Ramaswamy, "Advances Key For Coalbed Methane," *The American Oil & Gas Reporter,* pp. 71 & 73, Oct. 2001.
Arfon H. Jones et al., A Review of the Physical and Mechanical Properties of Coal with Implications for Coal–Bed Methane Well Completion and Production, *Rocky Mountain Association of Geologists*, pp. 169–181, 1988.
Joseph C. Stevens, Horizontal Applications For Coal Bed Methane Recovery, *Strategic Research Institute,* pp. 1–10 (slides), Mar. 25, 2002.
U.S. Appl. No. 10/194,368, entitled "Wellbore Sealing System and Method," filed Jul. 12, 2002, (22 pgs. of spec./3 pgs. of drawings).
Dreiling, Tim, McClelland, M.L. and Bilyeu Brad, "Horizontal & High Angle Air Drilling in the San Juan Basin, New Mexico," Believed to be dated Apr. 1996, pp. 1–11.
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—The U.S. Experience," Website, http://aapg.confex.com/...//, printed Nov. 16, 2004 (1 page).
U.S. Department of Interior, U.S. Geological Survey, "Characteristics of Discrete and Basin–Centered Parts of the Lower Silurian Regional Oil and Gas Accumulation, Appalachian Basin: Preliminary Results From a Data Set of 25 oil and Gas Fields," U.S. Geological Survey Open–File Report 98–216, Website, http://pubs.usgs.gov/of/1998/of98–216/introl.htm, printed Nov. 16, 2004 (2 pages).
Zupanick, J., "Coalbed Methane Extraction," 28$^{th}$ Mineral Law Conference, Lexington, Kentucky, Oct. 16–17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22–23, 2004 (51 pages).

Field, Tony, Mitchell Drilling, "Let's Get Technical—Drilling Breakthroughs in Surface to In–Seam in Australia," Presentation at Coal Seam Gas & Mine Methane Conference in Brisbane, Nov. 22–23, 2004 (20 pages).

Zupanick, Joseph A, "Coal Mine Methane Drainage Utilizing Multilateral Horizontal Wells," 2005 SME Annual Meeting & Exhibit, Feb. 28–Mar. 2, 2005, Salt Lake City, Utah (6 pages).

The Official Newsletter of the Cooperative Research Centre for Mining Technology and Equipment, CMTE News 7, "Tight–Radius Drilling Clinches Award," Jun. 2001, 1 page.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart's Petroleum Engineer International, 1997 (4 pages).

Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie–Codreanu, J.C. Sabathier and E.R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).

Gamal Ismail, A.S. Fada'q, S. Kikuchi, E. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El–Khatib—ZADCO, Abu Dhabi, UAE, "Multi–Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borehole," RI–7800, Bureau of Mines Report of Investigations/1973, United States Department of the Interior, 1973 (31 pages).

William P. Diamond, "Methane Control for Underground Coal Mines," IC–9395, Bureau of Mines Information Circular, United States Department of the Interior, 1994 (51 pages).

Technology Scene Drilling & Intervention Services, "Weatherford Moves Into Advanced Multilateral Well Completion Technology" and Productivity Gains and Safety Record Speed Acceptance of UBS, *Reservoir Mechanics,* Weatherford International, Inc., 2000 Annual Report (2 pages).

"A Different Direction for CBM Wells," *W Magazine,* 2004 Third Quarter (5 pages).

Snyder, Robert E., "What's New in Production," *WorldOil Magazine,* Feb. 2005, [printed from the internet on Mar. 7, 2005], http://www.worldoil.com/magazine/MAGAZINE_DETAIL.asp?ART_ID=2507@MONTH_YEAR (3 pages).

Nazzal, Greg, "Moving Multilateral Systems to the Next Level, Strategic Acquisition Expands Weatherford's Capabilities," 2000 (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA–TR–0565, U.S. Department of Energy, Apr. 1993, 30 pages.

Santos, Helio, SPE, Impact Engineering Solutions and Jesus Olaya, Ecopetrol/ICP, *"No–Damage Drilling: How to Achieve this Challenging Goal?,"* SPE 77189, Copyright 2002, presented at the IADC/SPE Asia Pacific Drilling Technology, Jakarta, Indonesia, Sep. 9–11, 2002, 10 pages.

Santos, Helio, SPE, Impact Engineering Solutions, *"Increasing Leakoff Fressure with New Class of Drilling Fluid,"* SPE 78243, Copyright 2002, presented at the SPE/ISRM Rock Mechanics Conference in Irving, Texas, Oct. 20–23, 2002, 7 pages.

Franck Labenski, Paul Reid, SPE, and Helio Santos, SPE, Impact Solutions Group, *"Drilling Fluids Approaches for Control of Wellbore Instability in Fractured Formations,"* SPE/IADC 85304, Society of Petroleum Engineers, Copyright 2003, presented at the SPE/IADC Middle East Drilling Technology Conference & Exhibition in Abu Chabi, UAE, Oct. 20–22, 2003, 8 pages.

P. Reid, SPE, and H. Santos, SPE, Impact Solutions Group, *"Novel Drilling Completion and Workover Fluids for Depleted Zones: Avoiding Losses, Formation Damage and Stuck Pipe,"* SPE/IADC 85326, Society of Petroleum Engineers, Copyright 2003, presented at the SPE/IADC Middle East Drilling Conference & Exhibition in Abu Chabi, UAE, Oct. 20–22, 2003, 9 pages.

Craig C. White and Adrian P. Chesters, NAM; Catalin D. Ivan, Sven Maikranz and Rob Nouris, M–I L.L.C., *"Aphron–based drilling fluid: Novel technology for drilling depleted formations,"* World Oil, Drilling Report Special Focus, Oct. 2003, 5 pages.

Robert E. Snyder, "Drilling Advances," World Oil, Oct. 2003, 1 page.

U.S. Environmental Protection Agency, "Directional Drilling Technology," prepared for the EPA by Advanced Resources International under Contract 68–W–00–094, Coalbed Methane Outreach Program (CMOP), Website: http://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short–Radius Drilling Expands Horizontal Well Applications," Petroleum Engineer International, Apr. 1995, 6 pages.
Terry R. Logan, "Horizontal Drainhole Drilling Techniques Used in Rocky Mountains Coal Seams," Geology and Coal–Bed Methane Resources of the Northern San Juan Basin, Colorado and New Mexico, Rocky Mountain Association of Geologists, Coal–Bed Methane, San Juan Basin, 1988, pp. cover, 133–142.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24–26, Cincinnati, Ohio, 4 pages.
U.S. Climate Change Technology Program, "Technology Options for the Near and Long Term," 4.1.5 Advances in Coal Mine Methane Recovery Systems, pp. 162–164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi–Seam Completion Technology," Natural Gas Quarterly, E&P, Jun. 2004, pp. 78–81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," Dated on or about Mar. 6, 2003, pp. 1–11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/../news/v7nInn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI–97/0236, copyright 1997, 502 pages.
The Need for a Viable Multi–Seam Completion Technology for the Powder River Basin, Current Practice and Limitations, Gardes Energy Services, Inc., Believed to be 2003 (8 pages).
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US–03/30126 mailed Feb. 27, 2004.
Kalinin, et al., Translation of Selected Pages from Ch. 4, Sections 4.2 (p. 135), 10.1 (p. 402), 10.4 (pp. 418–419), "*Drilling Inclined and Horizontal Well Bores,*" Moscow, Nedra Publishers, 4 pages, 1997.
Field, T.W., "*Surface to In–seam Drilling—The Australian Experience,*" 10 pages, Undated.
Drawings included in CBM well permit issued to CNX stamped Apr. 15, 2004 by the West Virginia Department of Environmental Protection (4 pages).
Website of Mitchell Drilling Contractors, "*Services: Dymaxion—Surface to In–seam,*" http://www.mitchell drilling-.com/dymaxion.htm, printed as of Jun. 17, 2004, 4 pages.
Website of CH4, "About Natural Gas—Technology," http://www.eh4.com.su/ng_technology.html, copyright 2003, printed as of Jun. 17, 2004, 4 pages.
Thomson, et al., "*The Application of Medium Radius Directional Drilling for Coal Bed Methane Extraction,*" Lucas Technical Paper, copyrighted 2003, 11 pages.
U.S. Department of Energy, DB–FC26–01NT41148, "*Enhanced Coal Bed Methane Production and Sequestration of CO2 in Unmineable Coal Seams*" for Consol, Inc., accepted Oct. 1, 2001, 48 pages, including cover page.
U.S. Department of Energy, "Slant Hole Drilling," Mar. 1999, 1 page.

* cited by examiner

*Primary Examiner*—William Neuder
(74) *Attorney, Agent, or Firm*—Fish & Richardson P.C.

(57) ABSTRACT

In accordance with one embodiment of the present invention, a method for drilling wellbores includes drilling a main wellbore, disposing a casing string having a deflecting member at a lower end thereof in the main wellbore, disposing a drill string having a drill bit at a lower end thereof in the casing string, and drilling, with the drill bit, a first lateral wellbore at a first depth in the main wellbore. The method further includes transferring the casing string to a second depth in the main wellbore that is less than the first depth, disposing a first temporary plug in the main wellbore at the second depth to prevent gas from flowing up the main wellbore past the second depth, transferring the casing string to a third depth in the main wellbore that is less than the second depth, and drilling, with the drill bit, a second lateral wellbore at the third depth.

17 Claims, 4 Drawing Sheets

WELLBORE PLUG SYSTEM AND METHOD

TECHNICAL FIELD OF THE INVENTION

The present invention relates generally to systems and methods for the recovery of subterranean resources and, more particularly, to a wellbore plug system and method.

BACKGROUND OF THE INVENTION

Subterranean deposits of coal (typically referred to as "coal seams") often contain substantial quantities of entrained methane gas. Limited production and use of methane gas from coal seams has occurred for many years because substantial obstacles have frustrated extensive development and use of methane gas deposits in coal seams.

In recent years, various methods have been used to retrieve methane gas deposits from coal seams. One such method is the use of underbalanced drilling using a dual-string technique. As an example of this method, a fluid such as drilling fluid is circulated down a drill string, while another relatively light fluid such as air or nitrogen is circulated down an annulus formed between an outside surface of a drill string and an inside surface of a casing string. A mixture of these fluids is retrieved from an annulus formed between an outer surface of the casing string and an inside surface of the wellbore after mixing with a gas or other fluid obtained from a lateral wellbore being drilled. The purpose of the lighter fluid is to lighten the weight of the drilling fluid such that the hydrostatic head of the drilling fluid does not force the drilling fluid into the subterranean formation and create detrimental effects.

SUMMARY OF THE INVENTION

The present invention provides a wellbore sealing system and method that substantially eliminates or reduces the disadvantages and problems associated with previous systems and methods.

In accordance with one embodiment of the present invention, a method for drilling wellbores includes drilling a main wellbore, disposing a casing string having a deflecting member at a lower end thereof in the main wellbore, disposing a drill string having a drill bit at a lower end thereof in the casing string, and drilling, with the drill bit, a first lateral wellbore at a first depth in the main wellbore. The method further includes transferring the casing string to a second depth in the main wellbore that is less than the first depth, disposing a first temporary plug in the main wellbore at the second depth to prevent gas from flowing up the main wellbore past the second depth, transferring the casing string to a third depth in the main wellbore that is less than the second depth, and drilling, with the drill bit, a second lateral wellbore at the third depth.

Some embodiments of the present invention may provide one or more technical advantages. These technical advantages may include more efficient drilling and production of methane gas and greater reduction in costs and problems associated with other drilling systems and methods. For example, there may be less damage to lateral wellbores because of mud or other fluids entering a lateral wellbore from the drilling of another lateral wellbore. In addition, cuttings are prevented from dropping into lower lateral wellbores while an upper lateral wellbore is being drilled. Another technical advantage includes providing a method for killing a lateral wellbore, while still being able to drill another lateral wellbore. An additional technical advantage is that underbalanced drilling may be performed along with the teachings of one embodiment of the present invention.

Other technical advantages of the present invention are readily apparent to one skilled in the art from the figures, descriptions, and claims included herein.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Embodiments of the present invention and their advantages are best understood by referring now to FIGS. 1 through 4 of the drawings, in which like numerals refer to like parts.

Figure 1:
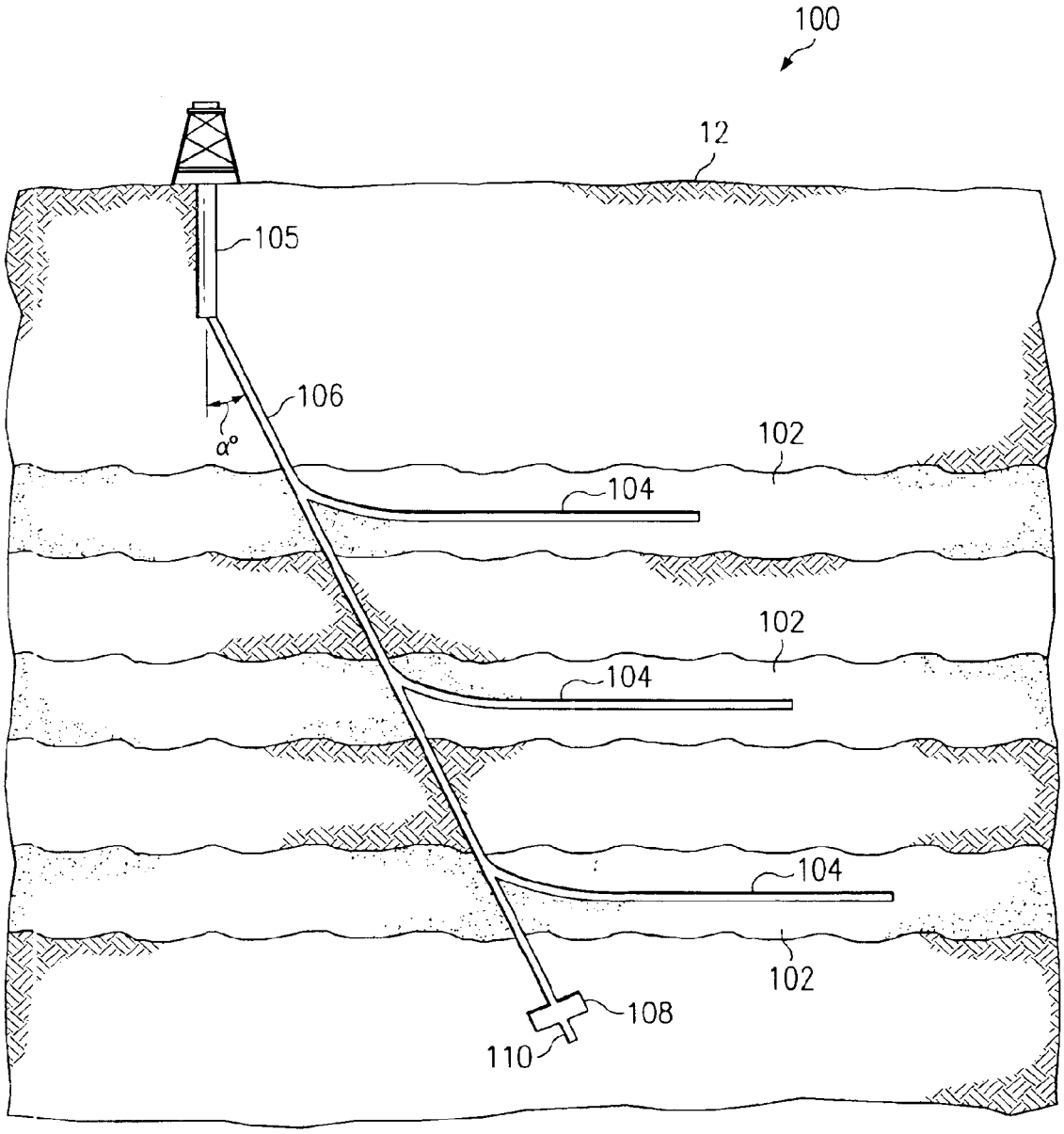
FIG. 1 is a cross-sectional view of an example slant well system for production of resources from one or more subterranean zones via one or more lateral wellbores.

FIG. 1 is a cross-sectional view of an example well system 100 for production of resources from one or more subterranean zones 102 via one or more lateral wellbores 104. In various embodiments described herein, subterranean zone 102 is a coal seam; however, other subterranean formations may be similarly accessed using well system 100 of the present invention to remove and/or produce water, gas, or other fluids. System 100 may also be used for other suitable operations, such as to treat minerals in subterranean zone 102 prior to mining operations, to inject or introduce fluids, gasses, or other substances into subterranean zone 102, or for any other appropriate purposes.

Referring to FIG. 1, well system 100 includes an entry wellbore 105, a main wellbore 106, a plurality of lateral wellbores 104, a cavity 108 associated with main wellbore 106, and a rat hole 110 associated with main wellbore 106. Entry wellbore 105 extends from a surface 12 towards subterranean zones 102. Entry wellbore 105 is illustrated in FIG. 1 as being substantially vertical; however, entry wellbore 105 may be formed at any suitable angle relative to surface 12 to accommodate, for example, surface 12 geometries and/or subterranean zone 102 geometries.

Main wellbore 106 extends from the terminus of entry wellbore 105 toward subterranean zones 102, although main wellbore may alternatively extend from any other suitable portion of entry wellbore 105. Where there are multiple subterranean zones 102 at varying depths, as illustrated in FIG. 1, main wellbore 106 extends through the subterranean zone 102 closest to surface 12 into and potentially through the deepest subterranean zone 102. There may be one or any number of main wellbores 106. As illustrated, main wellbore 106 is a slant well and, as such, is formed to angle away from entry wellbore 105 at an angle designated $\alpha$, which may be any suitable angle. Main wellbore 106 may also include cavity 108 and/or rat hole 110 located at a terminus thereof. Main wellbore 106 may include one, both, or neither cavity 108 and rat hole 110.

Lateral wellbores 104 extend from main wellbore 106 into an associated subterranean zone 102. Lateral wellbores 104 are shown in FIG. 1 to be substantially horizontal; however, lateral wellbores 104 may be formed in other suitable directions off of main wellbore 106 and may have a curvature associated therewith. Any suitable systems and/or methods may be used to drill lateral wellbores 104; however, example systems for drilling lateral wellbores 104 according to various embodiments of the present invention are described below in conjunction with FIGS. 2 and 3.

Figure 2:
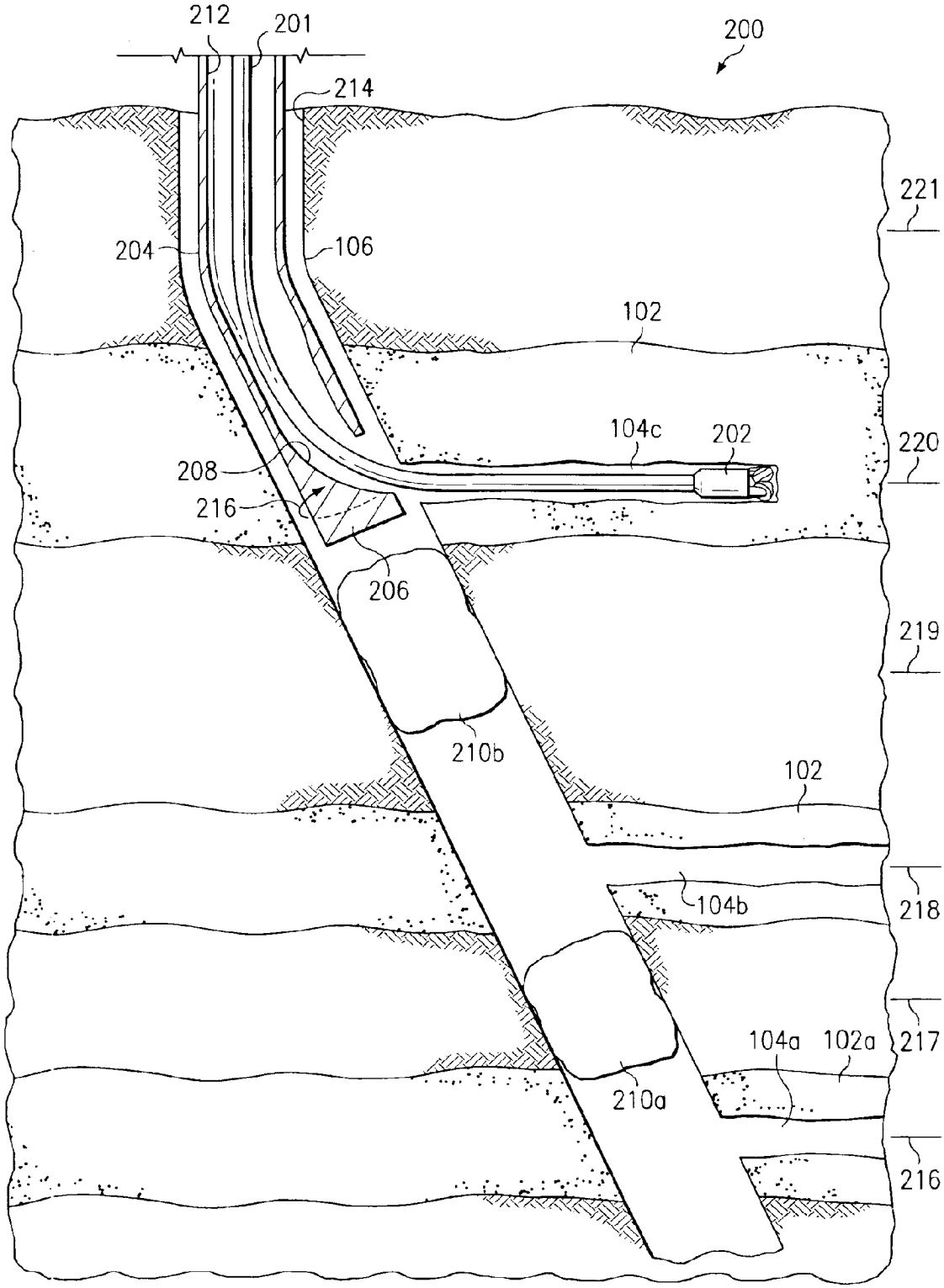
FIG. 2 illustrates an example system for drilling lateral wellbores according to one embodiment of the present invention.

FIG. 2 illustrates an example system 200 for drilling lateral wellbores 104 according to one embodiment of the present invention. As illustrated, system 200 includes a drill string 201 having a drill bit 202, a casing string 204, a deflecting member 206 having a deflecting surface 208 coupled to a lower end of casing string 204, and one or more temporary plugs 210 disposed within main wellbore 106.

Drill string 201 may be any suitable drill string having any suitable length and diameter and any suitable drill bit 202 for the purpose of drilling lateral wellbores 104. Drill string 201 is typically a hollow conduit for allowing drilling fluids to flow therethrough. Drill bit 202 may be driven through the use of any suitable motor powered by the drilling fluid or otherwise powered and may have any suitable configuration. To direct drill string 201 and drill bit 202 for the purpose of drilling lateral wellbore 104, deflecting surface 208 of deflecting member 206 is utilized.

Casing string 204 may be any suitable casing string having any suitable diameter that is to be inserted into main wellbore 106. Casing string 204 may be adapted to rotate within main wellbore 106 as illustrated by arrow 216. Although arrow 216 is illustrating a counterclockwise direction, casing string may also be rotated in a clockwise direction. An inner annulus 212 is formed between the inner surface of casing string 204 and the outer surface of drill string 201. An outer annulus 214 is also formed between an outside surface of casing string 204 and the surface of main wellbore 106. Inner annulus 212, outer annulus 214, and drill string 201 may be used to perform underbalanced drilling. As one example of underbalanced drilling, a first fluid may be circulated down drill string 201, such as drilling mud or other suitable drilling fluids. A second fluid is circulated down inner annulus 212, such as air, nitrogen, or other relatively light fluid. Both first and second fluids may be retrieved from outer annulus 214 after mixing with a gas or other fluid produced from lateral wellbore 104. The purpose of the second fluid is to lighten the weight of the first fluid such that the hydrostatic head of the first fluid does not force first fluid into the subterranean formation. As a variation, the second fluid may be circulated down outer annulus 214 and the mixture of the first and second fluids along with the gas from lateral wellbore 104 may be retrieved via inner annulus 212.

According to the teachings of the present invention, each temporary plug 210 is adapted to plug main wellbore 106 such that a gas or other fluid existing in main wellbore 106 below temporary plug 210 is prevented from flowing upward past temporary plug 210. In addition, any drilling fluid or cuttings are prevented from flowing down main wellbore 106 past temporary plug 210. In one embodiment of the invention, this allows the drilling of a lateral wellbore 104*a* in a subterranean zone 102*a* at a first depth 216 and then the drilling of a lateral wellbore 104*b* in a subterranean zone 102*b* at a third depth 218, while ensuring that any gas or other fluid obtained from lateral wellbore 104*a* at first depth 216 does not flow past a temporary plug 210*a* existing at a second depth 217 and interfere with the drilling of lateral wellbore 104*b* at third depth 218.

In one embodiment, temporary plugs 210 are formed from a bentonite clay; however, temporary plugs 210 may be formed from a polymer or other suitable viscous material. In addition, any suitable type of accelerator and/or catalyst may be added to the material that forms temporary plugs 210 in order to speed the curing time of temporary plugs 210 to a suitable time period. Temporary plugs 210 may be other suitable plugs, such as mechanical plugs, drill plugs, and cement plugs. Each temporary plug 210 may have any suitable length within main wellbore 106. Any suitable system or method may be used to install temporary plugs 210 in main wellbore 106; however, in one embodiment, casing string 204 is utilized to deliver the material down to the desired depth.

In operation of one embodiment of system 200 of FIG. 2, main wellbore 106 is drilled via any suitable method. Casing string 204 having deflecting member 206 attached thereto is inserted into main wellbore 106. Once at a desired depth, such as first depth 216, drill string 201 having drill bit 202 is inserted within casing string 204 so that lateral wellbore 104*a* may be drilled at first depth 216. After drilling lateral wellbore 104*a*, drill bit 202 is retracted from lateral wellbore 104*a* and casing string 204 is then raised to second depth 217 so that temporary plug 210*a* may be disposed within main wellbore 106 at second depth 217. The disposing of temporary plug 210*a* in main wellbore 106 prevents any gas or other fluid produced from lateral wellbore 104*a* from flowing up main wellbore 106 from a depth below temporary plug 210*a* past second depth 217. As mentioned previously, this allows successive lateral wellbores 104 to be drilled at successively higher depths while ensuring that any gas or other fluid from a lower lateral wellbore 104 does not cause detrimental effects.

After disposing temporary plug 210*a*, casing string 204 is transferred to third depth 218 where lateral wellbore 104*b* is drilled with drill bit 202. After drilling lateral wellbore 104*b*, drill bit 202 is retracted from lateral wellbore 104*b* and casing string 204 is then raised to a fourth depth 219 where a temporary plug 210*b* is disposed within main wellbore 106. Temporary plug 210*b* prevents any gas or other fluid from lateral wellbore 104*b* from flowing up to a depth in main wellbore 106 higher than fourth depth 219. Other lateral wellbores 104, such as a lateral wellbore 104*c*, may be drilled at higher depths according to a similar procedure as described above.

When the gas or other fluid from all drilled lateral wellbores 104 are desired to be accessed, then each temporary plug 210 that has been disposed within main wellbore 106 may be removed from main wellbore 106 using any suitable procedure, such as drilling. Alternatively, temporary plugs 210 may be removed by their dissolving over a period of time if temporary plugs 210 are formed from a material suitable to dissolve over a period of time. Another example of the use of temporary plugs 210 is shown below in conjunction with FIG. 3.

Figure 3:
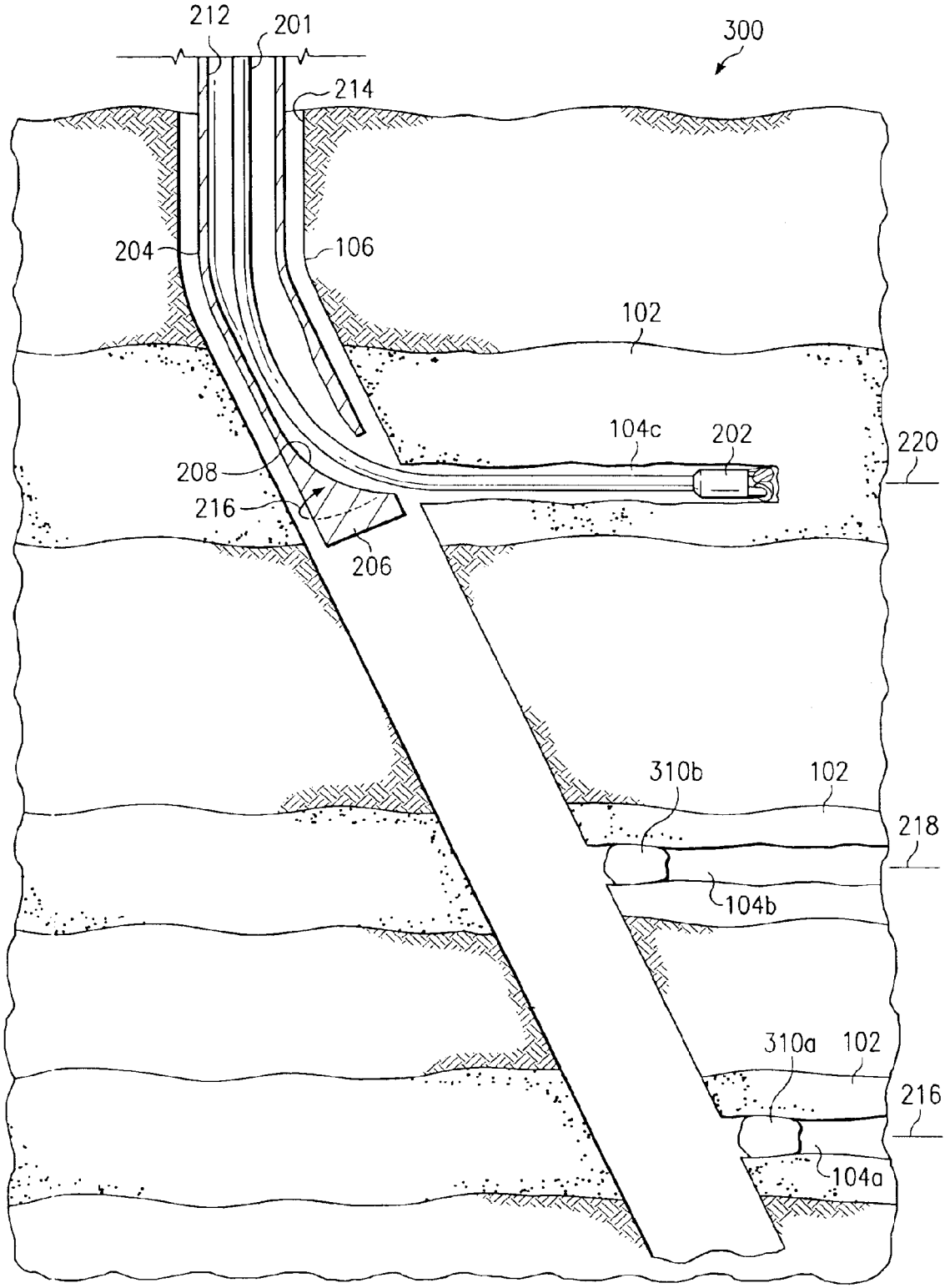
FIG. 3 illustrates another example system for drilling lateral wellbores according to one embodiment of the present invention.

FIG. 3 illustrates another example system 300 for drilling lateral wellbores 104 according to one embodiment in the present invention. System 300 is similar to system 200 described above; however, a difference is that one or more temporary plugs 310 are disposed within each lateral wellbore 104 instead of being disposed within main wellbore 106. Accordingly, when lateral wellbore 104*a* is drilled at first depth 216, then a temporary plug 310*a* is disposed within lateral wellbore 104*a* at a location adjacent to main wellbore 106 to prevent any gas or other liquid from lateral wellbore 104*a* from flowing into main wellbore 106. Casing string 204 and drill bit 202 may then be raised to third depth 218 so that lateral wellbore 104*b* may be drilled. After drilling lateral wellbore 104*b*, a temporary plug 310*b* is installed in lateral wellbore 104*b* at a location adjacent to main wellbore 106. This prevents any gas or other fluid from flowing from lateral wellbore 104*b* into main wellbore 106*b*. Successively higher lateral wellbores 104 may be drilled at successively higher depths using similar procedures. Temporary plugs 310 may be installed using any suitable method; however, in one embodiment, the material that forms temporary plugs 310 is pumped down drill string 201. The material that forms temporary plugs 310 may be the same as those described above in conjunction with temporary plugs 210. When gas or other fluid from all lateral wellbores 104 that have been drilled is desired, each temporary plug 310 may be removed using any suitable technique, such as those described above.

Figure 4:
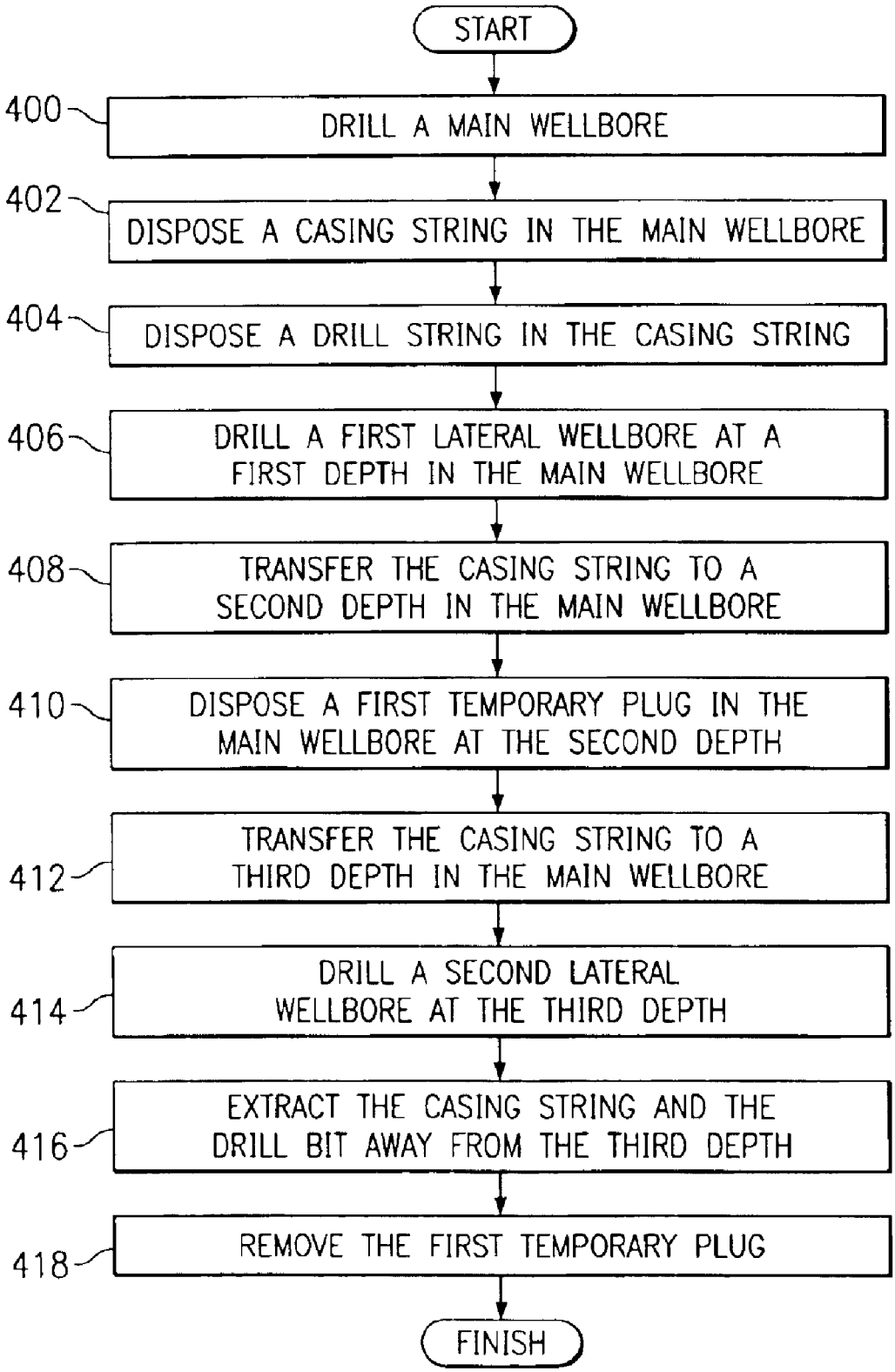
FIG. 4 is a flowchart demonstrating an example method for drilling lateral wellbores according to one embodiment of the present invention.

FIG. 4 is a flow chart demonstrating an example method of drilling lateral wellbores 104 according to one embodiment of the present invention. The method begins at step 400 where main wellbore 106 is drilled. Casing string 204 is disposed in main wellbore 106 at step 402. Casing string 204 has deflecting member 206 at a lower end thereof. At step 404, drill string 201 is disposed in casing string 204. Drill string 201 has drill bit 202 at a lower end thereof. At step 406, a first lateral wellbore 104*a* is drilled from main wellbore 106 at first depth 216. Deflecting surface 208 of deflecting member 206 is utilized to direct drill string 201 in the desired drilling direction.

At step 408, casing string 204 is transferred to second depth 217 in main wellbore 106 that is higher than first depth 216. At step 410, a first temporary plug 210 is disposed within main wellbore 106 at second depth 217 to prevent gas or other fluid from flowing up main wellbore 106 past second depth 217. To facilitate the disposing of first temporary plug 210, drill bit 202 is extracted away from second depth 217. In some embodiments, drill string 201 and drill bit 202 may be completely removed from casing string 204 before disposing first temporary plug 210. As an alternative to disposing first temporary plug 210 in main wellbore 106, first temporary plug 210 may be disposed in lateral wellbore 104*a* at first depth 216. After disposing first temporary plug 210, casing string 204 is transferred, at step 412, to third depth 218 in main wellbore 106 that is higher than second depth 217.

At step 414, a second lateral wellbore 104*a* is drilled from main wellbore 106 at third depth 218 with drill bit 202. Because first temporary plug 210 is disposed in main wellbore 106 at second depth 217, second lateral wellbore 104*b* may be drilled with the assurance that temporary plug 210 will prevent any gas from flowing upward to and past second lateral wellbore 104*b*.

At step 416, casing string 204 and drill bit 202 are extracted away from third depth 218. First temporary plug 210 may then be removed, at step 418, so that gas or other fluid may be obtained from lateral wellbores 104*a* and 104*b*. In the alternative embodiment where plug 210 is disposed in lateral wellbore 104*a*, casing string 204 and drill bit 202 do not have to be extracted away from third depth 218.

Although only two lateral wellbores 104*a* and 104*b* are drilled in the above described method, other successive lateral wellbores 104 may be drilled at successively higher depths in accordance with the above method. In this case, there would be a respective temporary plug 210 disposed within main wellbore 106 at a depth just above the depth of the respective lateral wellbore 104, except there does not need to be a temporary plug 210 for the shallowest lateral wellbore 104. In lieu of a slant well system, the described example method may be used with other suitable well systems.

Although the present invention is described with several embodiments, various changes and modifications may be suggested to one skilled in the art. The present invention intends to encompass such changes and modifications as they fall within the scope of the appended claims.

What is claimed is:

1. A method for drilling wellbores, comprising:

drilling a main wellbore;

disposing a casing string having a deflecting member at a lower end thereof in the main wellbore;

disposing a drill string having a drill bit at a lower end thereof in the casing string;

drilling, with the drill bit, a first lateral wellbore at a first depth in the main wellbore;

transferring the casing string to a second depth in the main wellbore that is less than the first depth;

disposing a first temporary plug in the main wellbore at the second depth to prevent gas from flowing up the main wellbore past the second depth without removing the casing string from the main well bore;

transferring the casing string to a third depth in the main wellbore that is less than the second depth;

drilling, with the drill bit, a second lateral wellbore at the third depth; and removing the first temporary plug, wherein removing the first temporary plug comprises either drilling through the first temporary plug or dissolving the first temporary plug.

2. The method of claim 1, further comprising:

transferring the casing string to a fourth depth in the main wellbore that is less than the third depth;

disposing a second temporary plug in the main wellbore at the fourth depth to prevent gas from flowing up the main wellbore past the fourth depth; and drilling, from the main wellbore, a third lateral wellbore at a fifth depth in the main wellbore that is less than the fourth depth.

3. The method of claim 1, further comprising:

extracting the casing string and the drill bit away from the third depth.

4. The method of claim 1, wherein drilling the main wellbore comprises drilling a slant wellbore.

5. The method of claim 1, wherein the first temporary plug is formed from a material selected from the group consisting of a polymer, a bentonite clay, a mechanical plug, a gel plug, and a cement plug.

6. The method of claim 1, further comprising disposing the casing string in the main wellbore such that an outer annulus is formed between a wall of the main wellbore and an outer wall of the casing string, and disposing the drill string in the casing string such that an inner annulus is formed between an inner wall of the casing string and an outer wall of the drill string.

7. The method of claim 6, further comprising:

circulating a first fluid down an inner passage of the drill string;

circulating a second fluid down the inner annulus; and retrieving a mixture of the first and second fluids and the gas from the lateral wellbore through the outer annulus.

8. The method of claim 6, further comprising:

circulating a first fluid down an inner passage of the drill string;

circulating a second fluid down the outer annulus; and retrieving a mixture of the first and second fluids and the gas from the lateral wellbore through the inner annulus.

9. A method for drilling wellbores, comprising:

drilling a main wellbore;

drilling a plurality of lateral wellbores from the main wellbore, the lateral wellbores being drilled at successively lesser depths;

disposing a temporary plug in the main wellbore at a depth above the depth of at least one of the lateral wellbores; and removing the temporary plug after drilling is complete, wherein removing the temporary plug comprises either drilling through or dissolving the temporary plug.

10. The method of claim 9, wherein drilling the main wellbore comprises drilling a slant wellbore.

11. The method of claim 9, wherein each temporary plug is formed from a material selected from the group consisting of a polymer, a bentonite clay, a mechanical plug, a gel plug, and a cement plug.

12. A method for drilling wellbores, comprising:

drilling a main wellbore;

disposing a casing string having a deflecting member at a lower end thereof in the main wellbore;

disposing a drill string having a drill bit at a lower end thereof in the casing string;

drilling, with the drill bit, a first lateral wellbore at a first depth in the main wellbore;

disposing a first temporary plug in the first lateral wellbore adjacent the main wellbore to prevent gas from flowing from the first lateral wellbore without removing the casing string from the main well bore;

transferring the casing string and the drill bit to a second depth in the main wellbore that is less than the first depth;

drilling, with the drill bit, a second lateral wellbore at the second depth; and removing the first temporary plug, wherein removing the first temporary plug comprises either drilling through the first temporary plug or dissolving the first temporary plug.

13. The method of claim 12, further comprising:

disposing a second temporary plug in the second lateral wellbore adjacent the main wellbore to prevent gas from flowing from the second lateral wellbore;

transferring the casing string and the drill bit to a third depth in the main wellbore that is less than the second depth; and drilling, from the main wellbore, a third lateral wellbore at the third depth.

14. The method of claim 12, wherein drilling the main wellbore comprises drilling a slant wellbore.

15. The method of claim 12, wherein the first temporary plug is formed from a material selected from the group consisting of a polymer, a bentonite clay, a mechanical plug, a gel plug, and a cement plug.

16. The method of claim 12, further comprising disposing the casing string in the main wellbore such that an outer annulus is formed between a wall of the main wellbore and an outer wall of the casing string, and disposing the drill string in the casing string such that an inner annulus is formed between an inner wall of the casing string and an outer wall of the drill string.

17. The method of claim 16, further comprising:

circulating a first fluid down an inner passage of the drill string;

circulating a second fluid down the inner annulus; and retrieving a mixture of the first and second fluids and the gas from the lateral wellbore through the outer annulus.

* * * * *